United States Patent [19]

Cone et al.

[11] 4,258,088

[45] Mar. 24, 1981

[54] METHOD FOR THE UNIFORM APPLICATION OF FOAMED LIQUID MIXTURES TO SUBSTRATES

[76] Inventors: Charles N. Cone, 10100 SW. Highland Dr., Tigard, Oreg. 97223; Julius M. Steinberg, Rte. 1, Box 19, Forest Grove, Oreg. 97116

[21] Appl. No.: 792,977

[22] Filed: May 2, 1977

Related U.S. Application Data

[60] Continuation-in-part of Ser. No. 615,130, Sep. 22, 1975, abandoned, which is a division of Ser. No. 346,630, Mar. 3, 1973, Pat. No. 3,905,329.

[51] Int. Cl.[3] ..... B05D 3/02

[52] U.S. Cl. ..... 427/316

[58] Field of Search ..... 427/358, 243, 247, 316

[56] References Cited

U.S. PATENT DOCUMENTS

| | | | |
|---|---|---|---|
| 3,081,184 | 3/1963 | Mosher et al. | 427/345 |
| 3,218,193 | 9/1961 | Isaacson | 427/310 |

*Primary Examiner*—Bernard D. Pianalto

*Attorney, Agent, or Firm*—Eugene D. Farley

[57] ABSTRACT

Foamed liquid mixtures are applied to substrates, in particular foamed plywood glues, are spread on traveling wood veneers in the manufacture of plywood by a method comprising the following steps: The liquid is withdrawn from a source of the same, is subjected to a mechanical beating action wherein its density is reduced and is then passed to a reservoir or feed storage vessel. Density-reduced liquid is then foamed and the foam is continuously extruded or otherwise spread on an intermittently-moving substrate during the periods of motion of the substrate. The foamed liquid is continuously diverted from the substrate during the periods of rest of the substrate. The diverted foamed liquid then is defoamed by subjecting it to the same mechanical beating action applied to the liquid thereby increasing its density to substantially that of the density-reduced liquid. Thus, there is obtained a uniform density feed to the foamer making possible a uniform application of foamed liquid on the substrate even though the motion of the substrate is started and stopped at frequent intervals.

11 Claims, 5 Drawing Figures

METHOD FOR THE UNIFORM APPLICATION OF FOAMED LIQUID MIXTURES TO SUBSTRATES

This is a continuation-in-part of patent application Ser. No. 615,130, filed Sept. 22, 1975 and now abandoned, which in turn is a division of Ser. No. 346,630, filed Mar. 3, 1973, now U.S. Pat. No. 3,905,329.

BACKGROUND OF THE INVENTION

This invention relates to a method for the uniform application of foamed aqueous mixtures to substrates. It pertains particularly to a method for spreading foamed plywood glues on intermittently-moving wood veneers in the manufacture of plywood and is described herein with particular reference to this application. No limitation thereby is intended, however, since the method is applicable with equal facility to other situations in which foamed liquid is applied to a substrate.

In the U.S. Pat. No. 3,895,984 to Charles N. Cone and Julius M. Steinberg for PLYWOOD MANUFACTURE USING FOAMED GLUES there is disclosed method and apparatus for making plywood by continuously propelling a liquid plywood glue in unfoamed condition at a predetermined flow rate, continuously foaming the glue as it is propelled and continuously extruding or otherwise applying the foamed glue to the surface of wood veneers as they travel along a conveying system in the plywood mill assembly line.

This is accomplished by passing the unfoamed glue through an in-line foamer while maintaining the flow rate of the unfoamed and foamed glue substantially the same on a unit weight of liquiid glue per unit time basis. The veneers to which the foamed glue has been applied then are laid up into plywood assemblies and pressed into plywood panels.

This method has many advantages, including economy of glue use and uniformity of plywood product. In executing the method, however, it is important that the foamed glue be applied uniformly on the plywood veneers. Otherwise, the strength and other properties of the finished plywood will be non-uniform and unpredictable.

Achieving a uniform spread of foamed glue on the surfaces of wood veneers traveling along a plywood production line is a result difficult of achievement. This is for the reason that the operation of the line, and of the mechanical veneer lay-up machines included in it, is intermittent. It is necessary to shut down the line from time to time for various reasons, including mechanical failures, interruption of veneer supply, disarrangement of veneers in the machine, etc. The total down time of the line in a 24-hour period usually amounts to about 12% or a little less than three hours. However, the interruptions are frequent. Each one lasts only a few minutes.

This characteristic of the operation of the plywood production line in turn means that the extruder or other foamed glue spreading device must be timed to stop and start with the line. At first sight, it would appear that this might be accomplished through the agency of a simple control valve actuated by a limit switch or other agency associated with the production line. In fact, it is a matter which is quite difficult of accomplishment.

The control of the flow of foamed glue must be highly accurate. When the line stops, the flow of foamed glue must stop. When the line resumes, the flow of foamed glue must resume and continue at the same rate as when it stopped. Otherwise, the spread rate will change.

Foamed liquids do not share the easily-controlled flow characteristics of ordinary liquids. The rate of flow from the extruder is a function of the pressure within the extruder head. Therefore, in order to insure a constant spread rate, the pressure within the head must be maintained the same at all times.

Simply shutting off the flow to the extruder when the line stops and resuming flow when it starts does not achieve the desired result. Foamed liquids, and particularly foamed phenolic resin glue, have two characteristics that make it necessary to take special precautions if the same flow is to be secured instantaneously after flow cut off as existed before cut off. These are first, a high degree of resistance to flow; and second, a high degree of compressibility.

Because of its high resistance to flow, a considerable amount of pressure is required to make the foamed glue move from the foaming unit where it is produced down the line and into the extruder.

For example, in normal operation of such a unit, the pressure in the line at the discharge port of the foaming unit will be in the neighborhood of 60–70 pounds per square inch. However, because of the high resistance to flow of the foamed liquid, the pressure in the extruder will be only 5–10 pounds per square inch. This steep pressure gradient is maintained during operation of the line by the force exerted by the unfoamed glue being pumped into the foaming unit.

If the foamed discharge from the extruder head is cut off and, simultaneously, the flow of unfoamed glue into the system also is cut off, the pressure gradient will disappear.

This occurrence is explained by the fact that at the instant of cut off, the foam in the line near the foaming unit is more highly compressed than it is in the extruder head. It consequently will expand until the pressure is equalized. This means that after cut off, the pressure inside the extruder head is higher than it was and the pressure in the foaming unit is lower than it was before cut off.

Because of this, when the operation of the line is resumed, the initial rate of flow of foamed glue from the extruder head will be much greater than normal. This then will be followed by a period of diminished rate of flow until the normal pressure gradient has been reestablished. This variation in flow in turn will be reflected in uneven application of the glue to the traveling veneers in the plywood production line.

Two solutions to the foregoing problem seem self-evident.

One is to shunt the non-uniform flow of foamed glue away from the extruder after cut off and discard it. This is not feasible first, because it is wasteful and costly; and second, because there is no place to put the discarded glue except in the sewer; and this leads to serious ecology problems.

The other apparent solution is to recycle the non-uniform portion of the glue flow back to the storage vessel which feeds the foamer and combine it there with the raw feed. This expedient is unsatisfactory because mixing the foamed glue with the unfoamed glue changes the density of the latter so that the density of the mixture varies with time. This, in turn, makes non-uniform the amount of glue discharged from the extruder since the amount of foamed glue dispensed by the extruder on a weight basis per unit time is a direct function of the amount of glue pumped to it from the system. The latter amount, in turn, is a direct function of the glue density.

It accordingly is the general purpose of the present invention to provide a method for overcoming the foregoing problem and for applying foamed liquids uniformly to substrates—in particular, foamed aqueous phenolic resin glues to traveling plywood veneers in a plywood mill production line.

It is a further object of the present invention to provide a method of the class described which is simple in concept and construction, easily included in the plywood line, easily and accurately operated and controlled, and relatively maintenance free.

In its broad concept, the present invention comprises a method for the uniform application of foamed liquids to substrates which comprises the following steps:

First, a source of foamable viscous liquid is provided. The viscous liquid is withdrawn from the source and is subjected to a mechanical beating action which tends to reduce the density of the liquid by mechanical entrainment of air therein. The liquid, now of somewhat reduced density, is passed to a reservoir or feed tank from which it is passed to a foamer. The foamed liquid is spread continuously on an intermittently and relatively-moving substrate during the periods of motion of the substrate relative to the foaming means employed.

The foamed liquid is diverted from the substrate during the periods of rest of the latter. The diverted foamed liquid then is subjected to the same mechanical beating action as was applied to the original liquid thus defoaming the liquid and increasing its density. Defoamed liquid is cycled back to the feed tank.

Defoaming the diverted foamed liquid restores it to substantially its original density, i.e., the density of the unfoamed liquid after it has been subjected to the mechanical beating action. As a consequence, the recycled defoamed liquid may be mixed with the mechanically-beaten liquid without adversely affecting its density and, hence, without adversely affecting the amount of liquid on a weight basis spread on the substrate.

DETAILED DESCRIPTION OF INVENTION

In the drawings

Figures 1, 2, 3, 4, 5:
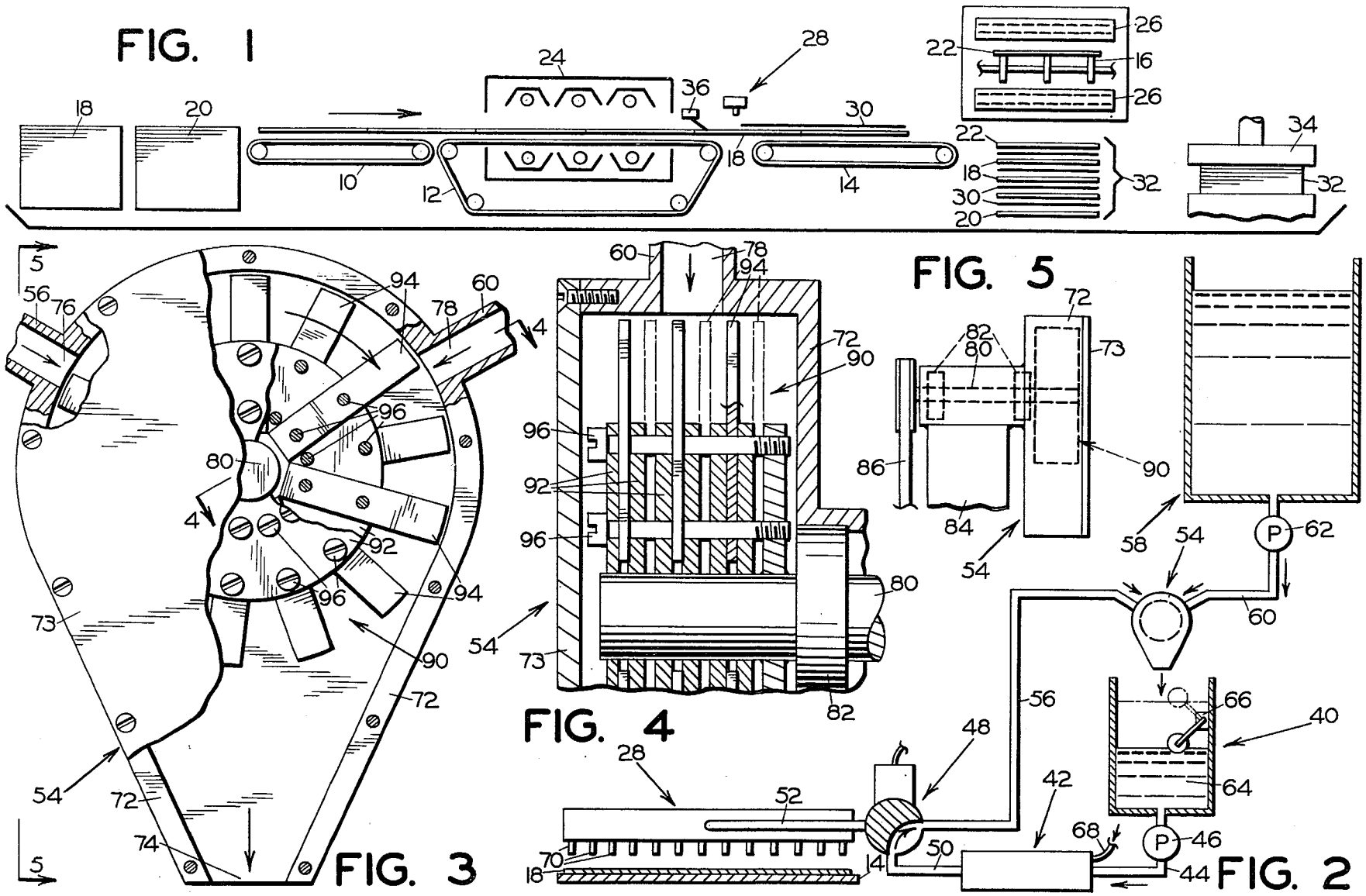
FIG. 1 is a schematic view in side elevation of a plywood production line including provision for applying foamed liquid glue uniformly to moving plywood veneers.
FIG. 2 is a schematic view in elevation, partly in section, of apparatus employed in the application of foamed liquids to substrates adaptable for inclusion in the production line of FIG. 1.
FIG. 3 is a view in front elevation, partly broken away and partly in section, and illustraring a defoaming unit which is a component of the apparatus of FIG. 2.
FIG. 4 is a fragmentary, detail sectional view taken along line 4—4 of FIG. 3.
FIG. 5 is a fragmentary side elevation of the defoaming unit of FIG. 3.

The production line illustrated schematically in FIG. 1 basically comprises the veneer lay-up line of a plywood manufacturing plant. It contains a foamed phenolic resin glue extruding unit, such as it is described in the aforesaid U.S. Pat. No. 3,895,984.

As illustrated in FIG. 1, the production line includes two wood veneer pre-heating lines running at right angles to each other and meeting at a common assembly station. One delivers core, center and back veneers to the assembly station. It comprises an infeed conveyer 10, a heater conveyer 12 and an outfeed conveyer 14. The second preheating line comprises a similar conveyor system 16 laid out at right angles to the first.

The first conveyer system conveys to the assembly a plurality of core veneers 18 and of back and center veneers 20. Conveyer system 16 conveys to the assembly a plurality of face veneers 22.

As they travel along the conveyer system including conveyer units 10, 12, 14, the core and back and center veneers are preheated with suitable heating units 24. Preferably, these comprise infrared heating units capable of heating the veneers to a temperature of from 200° to 400° F. during their time of passage through the heating unit.

As they travel along conveyer system 16, face veneers 22 are preheated to the same temperature level by means of heating elements 26.

Foamed glue is applied to core veneers 18 and back and center veneers 20. The application is made to the upper surfaces only of these veneers. it is made by meaans of a foamed glue extruder positioned downstream from heater 24 and indicated generally at 28. The extruder applies to the veneers a coating of foamed glue 30 in a pattern determined by the size and dimensions of its extruding orifices.

No adhesive whatsoever is applied to the surfaces of face veneers 22.

At the assembly station, the core, back, center and face veneers are composited into a plywood panel assembly 32. This is combined with other panel assemblies to form a press load which is transferred into a press 34 and consolidated into plywood panels. The press may be either a single opening or multiple opening hot press or a cold press.

The plywood lay-up line described above also includes an electric limit switch 36 positioned adjacent extruder 28 with its sensing element in contact with the moving veneers. As will appear hereinafter, the limit switch is in an electric circuit with a valve controlling the flow of foamed glue through the extruder and coordinates the discharge of glue by the extruder with the intermittent movement of the veneers.

Turning now to FIG. 2, there is shown the system for forming and applying foamed liquids to a moving substrate as in plywood manufacture. A storage tank 58 holds raw glue which is supplied to feed reservoir or tank 40 on an intermittently, as-needed basis. Raw glue is propelled by pump 62 through conduit 60 to defoamer 54 from whence it passes to feed reservoir 40. As the raw glue passes through defoamer 54, it is subjected to an intense mechanical beating action, as will be later described, which reduces the density of the raw glue.

Feed reservoir 40 serves as a working source of density reduced but unfoamed glue 64. It is fitted with a float operated switch 66 which controls the action of pump 62 so as to maintain an adequate supply of density reduced glue within the reservoir. Density reduced glue is then continuously pumped via conduit 44 to a foaming device 42 by means of a metering pump 46 which provides a constant volume flow. Pump 46 preferably is of the positive displacement type, such as a gear pump, and delivers accurately metered quantities of density reduced liquid glue to the foaming unit. Foamed glue is passed via conduit means 50 to an electrically-operated valve 48 which acts as a diversion point to direct the foamed glue either to foamed glue applicator or extruder 28 or to defoamer 54 from whence it is returned to reservoir 40.

Raw glue in storage tank 58 may typically have a density of about 1.1 g/cc. After passing through defoamer 54 where it is subjected to an intense mechanical beating action, density of the raw glue is reduced somewhat; typically to a value of about 0.9 to 0.95 g/cc. Density of the foamed glue may range from about 0.1 to 0.5 and preferably ranges from about 0.15 to 0.3 g/cc.

Foaming unit 42 is supplied with air or other foaming gas under pressure through inlet 68. It comprises means for vigorously agitating the liquid with gas and has a structure suitable to accomplish this purpose. A preferred structure is described and illustrated in detail in the aforesaid U.S. Pat. No. 3,895,984.

Located downstream from foaming unit 42 is electrically operated valve 48 which acts as a diversion point for the foamed glue, directing its flow either to extruder 28 via conduit 52 or to defoamer 54 via conduit 56. Valve 48 is preferably located in the extruder head itself at a point whereat there remains the least possible volume for foam to remain at rest within foam nozzles 70 at those times when flow is diverted from the extruder to the defoamer. This allows foam flow through the extruder nozzles to reach a uniform and equilibrium flow rate in the shortest possible time after flow has been restarted.

In order to function properly without flow surges of foamed glue, it is necessary to maintain the pressure drop from the foamer 42 to diversion point 48 substantially constant whether the foamed glue is passed to extruder 28 or to defoamer 54. This is accomplished by sizing conduit 56 such that it displays the same flow resistance to foamed glue as does conduit 52 and nozzles 70. As has been noted previously, valve 48 is electrically operated between its two positions in response to a signal from limit switch 36, the sensing element of which is positioned in contact with the moving veneers in the plywood lay-up line.

It is to be noted that defoamer 54 performs two functions. First, it reduces the density of the raw glue makeup stream that is fed through the defoamer. Second, it defoams the foamed glue which is diverted from the extruder during those periods when the plywood lay-up line is at rest. Defoaming acts to increase the density of the glue. As a result, both raw glue and foamed glue are brought to a common density by action of defoamer 54. Thus, there is avoided density variations of the glue supply in feed reservoir 40 which would in turn cause the weight of glue supplied by pump 46 to vary.

The extrusion unit 28 has for its function extruding the foamed glue in uniform streams onto the upper surfaces of the plywood veneers positioned on a conveyer immediately below. It may be of various types but preferably comprises a unit such as is described in detail in the aforesaid U.S. Pat. No. 3,895,984. In accordance with this disclosure, the foamed glue is pressure extruded through nozzles 70 in the form of ribbons, which are laid down in laterally-spaced relation lengthwise of the traveling veneers. As noted, it is essential for the production of a satisfactory plywood product that the glue be thus deposited in metered quantity at a uniform rate.

Defoaming unit 54, which is immediately downstream from extrusion unit 28 and valve 48, receives foamed glue diverted by valve 48 from extrusion unit 28 and transmitted via conduit 56 into the defoaming unit. It defoams the glue and returns it to reservoir 40.

The major portion of the make up of reservoir 40, however, is derived from a storage or holding tank 58. This communicates with feed tank or reservoir 40 via conduit 60. Conduit 60 includes a suitable pump 62 controlled by an electric circuit including float operated switch 66 in feed tank 40. It supplies fresh raw glue to tank 40, as required to meet the demands of the apparatus.

Although various types of defoaming units 54 may be included in the apparatus thus comprised, a novel and preferred type is illustrated in FIGS. 3, 4 and 5.

Basically, the defoaming unit illustrated in these figures comprises a mill or beater having a design such that the foam is beaten under conditions which break up its component bubbles and separate the foam into a liquid phase and a gas phase. In view of the fact that under other conditions a beating action may be employed to create a foam, rather than to destroy it, it is of interest that defoaming, rather than foaming is accomplished by the special design of the hereindescribed defoaming unit.

Defoaming unit 54 includes a pear-shaped case 72 having an arcuate upper portion and a restricted, open, lower portion which provides a discharge opening 74. Case 72 further is provided with a face plate 73 which is bolted to the case and provides access to the interior.

A pair of infeed ports 76, 78 communicate with the interior of the case at its upper, rounded end.

Port 76 is coupled to conduit 56 which delivers foamed glue diverted by valve 48 to a peripheral position at the upstream end of the flow generated within the defoamer.

Conduit 56 is designed to have substantially the same resistance to flow as do conduits 52 and extrusion nozzles 70. This insures that at the same driving pressure the rate of flow of the foamed glue will be substantially the same in the one as in the other.

Port 78 communicates with conduit 60 which delivers the feed stock from storage tank 58, and charges it into the case in a location downstream from infeed port 76.

Rotary beating means is mounted in case 72 for beating the foam introduced into the case via infeed port 76 and thus separating into its liquid and gaseous phases.

The beating means comprises a shaft 80 journaled in bearings 82 which in turn are supported on a frame member 84. The shaft is driven at a suitable rotational speed of about 3,000 rpm by means of a belt and pulley assembly 86 coupled to a motor, not illustrated.

The end of shaft 80 opposite to that which mounts belt and pulley assembly 86 mounts a rotor indicated generally at 90.

The rotor is arranged concentrically with the rounded upper end of the case and comprises a plurality of support plates 92 spaced longitudinally along the end of shaft 80 and positioned radially in substantial parallelism to each other. The plates are welded to the shaft.

A plurality of radial blades or arms 94 are interposed in staggered relation to each other in the spaces between support plates 92. They are secured releasably in place by means of bolts 96. The arms comprise flat plates of rectangular cross section and having a length sufficient to reach out into close proximity with the inner wall of the rounded portion of case 72.

Foamed glue introduced into the defoamer via infeed port 76 is driven around in the clockwise direction as viewed in FIG. 3 and subjected to the intense beating action of the leading edges of blades 94. This hammers the component bubbles of the foam and breaks the foam into liquid and gaseous phases.

The liquid phase is discharged through the open bottom discharge port 74 at the bottom of the unit and is returned to feed tank 40. The gas phase is dispersed into the atmosphere or conducted to a suitable venting facility. Raw feed liquid introduced into the defoamer via conduit 60 also passes in a short cycle through the rotor. However, it is adjusted to a density level approximating that of the defoamed glue.

OPERATION

A typical operation of the hereindescribed apparatus for applying foamed liquids to substrates is as follows:

The liquid employed in this example is an aqueous, alkaline, phenol-formaldehyde resinous plywood glue mixed with a foaming agent in suitable amount and having a viscosity of 3–10 poises and a density of about 1.1 grams per cc.

To start the operation with clean and empty equipment, pump 62 draws glue at a density of 1.1 from storage tank 58 and propels it through defoamer 54 into feed tank 40. Operation of the defoamer through some unknown mechanism reduces the density of the glue to about 0.93 grams per cc. When the level of glue in the feed tank is sufficient to actuate float switch 66, pump 62 shuts off.

Next pump 46 is started. It draws glue from tank 40 and propels it through foaming unit 42 to valve 48. The valve diverts the foamed glue, which has a density of about 0.2 g./cc., back into defoamer 54, which delivers it in defoamed condition back into feed tank 40. It is delivered defoamed at a density of about 0.93 g./cc., the same density as it had when it left the tank.

As pump 46 continues to operate and fills the lines, the pressure at the outlet of foamer 42 and at valve 48, which in practice may be located to advantage inside extruder 28, rises and finally stabilizes at values of about 50 psi at the foamer and about 10 psi at the valve. When this gradient has become stabilized, extrusion is started by turning valve 48 so as to connect the foamer to the extruder and simultaneously divert the flow of foam away from the defoamer.

When this occurs, the pressure inside the extruder will not change. This is for the reason that conduits 56 on the one hand and the conduit system including discharge nozzles 70 on the other hand, are dimensioned to have the same resistance to flow. Accordingly, one path is as favorable as the other to the foamed liquid.

The foamed glue is discharged through extruder 28 as long as the moving veneers on the plywood production line activate switch 36. However, when the motion of the veneers is arrested, switch 36 shifts the position of valve 48 so that the foamed liquid is diverted to defoamer 54 and returned in defoamed condition to tank 40.

Since the glue is delivered to tank 40 at the same density (0.93 g./cc.) whether it comes from storage tank 58 through defoamer 54, or from the extruder 28 through the same defoamer, the rate at which pump 46 propels glue into the system remains constant.

Since pump 46 delivers glue into the system at a constant rate and the pressure at the extruder remains the same whether the foamed glue is being extruded or not, the pressure gradient in the line will remain constant. The rate of flow to the extruder will remain the same at all times and the rate of flow through the extrusion nozzles will be unaffected when the flow in the nozzles is stopped and started again.

The system thus may be stopped and started as often as required by the demands of the plywood assembly line without disadvantage to the uniformity of foamed glue spread on the veneers. Furthermore, this is accomplished without loss of glue and without incurring a pollution problem resulting from the discharge of waste glue into facilities wherein it is detrimental.

Having thus described our invention in preferred embodiments, we claim:

1. A method for the uniform application of a foamed viscous liquid to an intermittently-moving substrate which comprises:

(a) subjecting the raw liquid to a mechanical beating action whereby its density is reduced;

(b) passing said liquid of reduced density to a feed reservoir;

(c) withdrawing liquid from said feed reservoir and passing said liquid to a foamer;

(d) foaming said liquid and passing it to a diversion point while maintaining a constant and predetermined pressure drop between the foamer and diversion point;

(e) passing the foamed liquid from the diversion point to a foam spreader and continuously depositing the foamed liquid as a foam on said intermittently-moving substrate during its period of motion while substantially maintaining said constant and predetermined pressure drop;

(f) diverting the foamed liquid from the diversion point during those periods wherein said intermittently moving substrate is at rest;

(g) subjecting said diverted foamed liquid to a mechanical beating action operable to increase its density to substantially that of said liquid of reduced density while substantially maintaining said constant and predetermined pressure drop, and (h) passing the mechanically beaten liquid to said feed reservoir.

2. The method of claim 1 wherein the substrate comprises plywood veneer and the foamable liquid comprises a foamable plywood glue.

3. The method of claim 2 wherein the glue is withdrawn continuously from said reservoir and wherein the withdrawn glue is continuously foamed.

4. The method of claim 2 wherein the foamable plywood glue comprises a foamable phenolic resin glue.

5. The method of claim 3 wherein the glue comprises a foamable aqueous alkaline phenolformaldehyde resin having an original density in the raw state of more than about 1.0 g/cc and wherein its density is reduced to about 0.9 to 0.95 g/cc by said mechanical beating action.

6. The method of claim 5 wherein the glue of reduced density is foamed to a density in the range of 0.1 to 0.5 g/cc and wherein diverted foamed glue is subjected to a mechanical beating action which increases its density to about 0.9 to 0.95 g/cc.

7. The method of claim 6 wherein the glue of reduced density is foamed to a density in the range of 0.15 to 0.3 g/cc.

8. The method of claim 3 wherein said glue is withdrawn from the feed reservoir and passed to the foamer at a substantially constant volume rate.

9. The method of claim 3 wherein the foamed glue is applied to said plywood veneer by extruding it thereon.

10. The method for the uniform spreading of a foamed, viscous liquid glue on an intermittently moving substrate which comprises:

(a) providing a communicating conduit system including: a reservoir; downstream from the reservoir a foamer; downstream from the foamer a diversion point; and downstream from the diversion point in separate conduits a foam spreader and a defoamer, (b) pumping unfoamed liquid glue from the reservoir to the foamer, thereby establishing in the conduit system a glue-driving pressure differential, (c) maintaining the pressure differential between the foamer and the diversion point at a substantially constant and predetermined value, (d) converting the liquid glue in the foamer to the condition of a stable foam of predetermined density, (e) delivering the foam to the spreader during the periods of motion of the substrate, (f) spreading the foam delivered to the spreader on the substrate to form a foamed glue coating thereon, (g) diverting the foam to the defoamer during the periods of rest of the substrate, (h) defoaming the foam delivered to the defoamer, and (i) cycling the defoamed glue back to the reservoir.

11. The method of claim 10 including the step of adjusting the densities of the unfoamed liquid glue in the reservoir and the defoamed foam cycled back thereto to a common density.

* * * * *